US011125484B2

(12) United States Patent
Chatelle et al.

(10) Patent No.: US 11,125,484 B2
(45) Date of Patent: Sep. 21, 2021

(54) FLEXING TRAY ICE-MAKER WITH AC DRIVE

(71) Applicant: ILLINOIS TOOL WORKS INC., Glenview, IL (US)

(72) Inventors: William D. Chatelle, Cranston, RI (US); Juan Barrena, Johnson, RI (US)

(73) Assignee: Illinois Tool Works Inc., Glenview, IL (US)

( * ) Notice: Subject to any disclaimer, the term of this patent is extended or adjusted under 35 U.S.C. 154(b) by 144 days.

(21) Appl. No.: 16/075,181

(22) PCT Filed: Jan. 25, 2017

(86) PCT No.: PCT/US2017/014871

§ 371 (c)(1),
(2) Date: Aug. 3, 2018

(87) PCT Pub. No.: WO2017/151247

PCT Pub. Date: Sep. 8, 2017

(65) Prior Publication Data

US 2019/0041112 A1 Feb. 7, 2019

Related U.S. Application Data

(60) Provisional application No. 62/302,313, filed on Mar. 2, 2016.

(51) Int. Cl.
*F25C 1/10* (2006.01)
*F25C 5/187* (2018.01)
(Continued)

(52) U.S. Cl.
CPC ..... *F25C 1/10* (2013.01); *F25C 1/243* (2013.01); *F25C 1/25* (2018.01); *F25C 5/187* (2013.01); *F25C 5/22* (2018.01); *F25C 5/24* (2018.01); *F25C 2305/022* (2013.01); *F25C 2400/14* (2013.01); *F25C 2600/04* (2013.01); *F25C 2700/02* (2013.01)

(58) Field of Classification Search
CPC ..... F25C 1/08; F25C 1/25; F25C 1/10; F25C 1/22; F25C 5/24; F25C 5/22; F25C 5/243; F25C 5/187; F25C 2305/022; F25C 2400/14; F25C 2600/04
See application file for complete search history.

(56) References Cited

U.S. PATENT DOCUMENTS 3,863,461 A 2/1975 Bright
3,926,007 A 12/1975 Braden et al.
(Continued)

FOREIGN PATENT DOCUMENTS

JP 2008057894 A 3/2008

*Primary Examiner* — Elizabeth J Martin
*Assistant Examiner* — Nael N Babaa
(74) *Attorney, Agent, or Firm* — Boyle Fredrickson, S.C.

(57) ABSTRACT

An ice-maker provides a reversible AC motor whose direction is changed at a first and second stop positioning the tray in a filling position and an ice cubes discharging position, respectively. A bail arm may introduce an additional stop preventing discharge of ice when an ice bin is full. User controls may allow the user to set a water fill time based on local water pressure conditions. An ice tray incorporating an ice sensor may releasably connect to the ice-making machine for ready replacement.

19 Claims, 5 Drawing Sheets

(51) Int. Cl.

| | |
|---|---|
| ***F25C 1/25*** | (2018.01) |
| ***F25C 5/20*** | (2018.01) |
| ***F25C 1/243*** | (2018.01) |

(56) References Cited

U.S. PATENT DOCUMENTS

| | | | | |
|---|---|---|---|---|
| 4,402,194 | A | 9/1983 | Kuwako et al. | |
| 2004/0194480 | A1* | 10/2004 | Kim | F25C 1/04 62/135 |
| 2010/0207557 | A1* | 8/2010 | Wilkinson | H02P 1/22 318/400.15 |
| 2010/0319385 | A1 | 12/2010 | Hashimoto | |
| 2012/0186288 | A1 | 7/2012 | Hapke | |
| 2014/0165620 | A1* | 6/2014 | Culley | F25C 1/18 62/71 |
| 2015/0082816 | A1* | 3/2015 | Park | F25C 1/04 62/66 |
| 2015/0276295 | A1 | 10/2015 | Barrena et al. | |

* cited by examiner

FLEXING TRAY ICE-MAKER WITH AC DRIVE

CROSS-REFERENCE TO RELATED APPLICATIONS

This application claims the benefit of U.S. provisional application 62/302,313 filed Mar. 2, 2016, and hereby incorporated by reference.

FIELD OF THE INVENTION

The present invention relates to ice-making machines for home refrigerators and the like and specifically to an ice-making machine providing a flexible tray for ejecting ice cubes while using an AC drive.

BACKGROUND OF THE INVENTION

Household refrigerators commonly include automatic ice-makers located in the freezer compartment. A typical ice-maker provides an ice cube mold positioned to receive water from an electric valve that may open for a predetermined time to fill the mold. The water is allowed to cool until a temperature sensor attached to the mold detects a predetermined low-temperature point where ice formation is ensured. At this point, the ice is harvested from the mold by a drive mechanism into an ice bin positioned beneath the ice mold. The amount of ice in the ice bin may be checked through the use of the bail arm which periodically lowers into the ice bin to cheek the ice level. If the bail, is blocked in its descent by a high level of ice, this blockage is detected and ice production is stopped.

One method of harvesting ice cubes from the molds employs a mold heater. Typically, in this case, the ice tray will be a metal die-cast part incorporating an electrical resistance heater which heats the ice tray to release the ice when the tray is inverted by a motor. The electrical resistance heater and the ice-maker motor normally operate directly at a fine voltage of about 120 volts AC eliminating the need for additional power processing for the motor 51 or, in some reduced complexity embodiments, sophisticated control electronics in the associated refrigerator.

An alternative method of harvesting ice cubes uses a flexible ice tray which is twisted by a DC motor receiving power and control signals from an external DC power source and control electronics in the associated refrigerator. Twisting of the tray ejects the ice cubes from the tray.

This latter approach can operate with considerable energy savings but is not available on some lines of refrigerators which do not provide the necessary DC power supplies for the motor or more sophisticated control electronics for producing the necessary control signals.

SUMMARY OF THE INVENTION

The present invention provides an ice-maker using a flexible tray but operating with an AC motor to eliminate the need for DC power processing not available in some refrigerator lines. Simple and precise bidirectional control of the AC motor is provided by interacting stops on a drive gear and the bail arm. The invention also provides an extremely simple user interface for an ice-maker allowing testing of the operation of the ice-maker, the outputting of error codes, and improved adjustment of tray fill level in low-pressure environments according to a teaching routine that may be conducted by the user. In addition, the ice tray provides a mechanical and electrical connector allowing it to be replaced through a simple unplugging and plugging operation.

Specifically then, in one embodiment, the present invention provides an ice-maker having an ice tray providing multiple cube forming compartments open on an upper face of the ice tray for receiving water to mold ice. A motor unit has a connector attachable to the ice tray to rotate the ice tray for filling of the ice tray with water in a first position and warpage of the tray to discharge the ice cubes from the tray in a second position. The motor unit further provides: (a) an AC motor operable to rotate the connector bi-stably in two directions; (b) a first and second stop blocking the rotation of the AC motor when the tray is in the first and second positions to cause reversal of the direction of operation of the AC motor at those positions; and (c) a position sensor sensing at least one rotated location of the tray. A controller responds to the position sensor to control power to the AC motor to provide a cycling of the tray between the first and second positions for ice making.

It is thus a feature of at least one embodiment of the invention to provide an extremely simple auto reversing mechanism for use in an ice-maker.

The ice-maker may further include an ice bin positioned beneath the ice tray to receive ice cubes discharged from the ice tray in the second position and a bail arm operable by the AC motor to descend into the ice bin as the tray moves from the first position to the second position. The ice-maker may further include a third stop blocking the rotation of the AC motor when the tray is between the first and second position before warpage of the tray, and the bail arm may provide a movable finger interacting with the third stop only when the bail arm is blocked at a predetermined elevation from descent into the ice bin indicating a full state of the ice bin, the interaction of the movable finger with the third stop reversing the AC motor before it reaches the second position.

It is thus a feature of at least one embodiment of the invention to employ a stop mechanism automatically reversing the AC motor to sense and respond to a full ice bin without the need for additional bail arm height sensing contacts or the like.

The movable finger may further interact with the first and second stops to block rotation of the AC motor at the first and second stops.

It is thus a feature of at least one embodiment of the invention to use the bail arm finger to provide a common interference mechanism for the first, second and third stops eliminating the need for additional structure.

The AC motor may be an AC synchronous motor.

It is thus a feature of at least one embodiment of the invention to make use of the bi-stable reversibility of the synchronous motor to simplify the mechanism of an ice-maker. It is another object of the invention to make use of a motor that can directly receive line power without the need for voltage regulation circuitry.

The controller may operate to provide power to the AC motor when the tray is between the first and second positions and to selectively stop the AC motor at the first and second positions, It is thus a feature of at least one embodiment of the invention to cycle the tray between various positions and to bold the tray at those positions using simple power control of an AC motor.

The connector may be axially connected to a gear having the first, second and third stops on a surface of the gear and the AC motor shaft may communicate with the gear through at least one additional gear.

It is thus a feature of at least one embodiment of the invention to control mechanical advantage to the AC motor so that it may be indifferent to normal frictional and tray warpage forces experienced during operation of the ice tray while nevertheless being reversible by mechanical stops.

The ice-maker may provide an electrically actuatable valve communicating with the controller to be activated by the controller for delivering water to the ice tray in the first position and may include at least one switch actuatable by a user of the ice-maker to open the valve at a first tune and close the valve at a second time indicating an amount of time necessary to fill the ice tray; and wherein the controller stores an indication of the amount of time to use to control the electrically actuatable valve at subsequent times when the tray is in the first position for filling with water.

It is thus a feature of at least one embodiment of the invention to provide a simple mechanism for the consumer to adjust for varying water pressures such as may affect filling of the ice tray.

The ice tray includes a sensor communicating with at least one cube-forming compartment to sense the formation of ice, and the connector may releasably attach to the ice tray and include releasable electrical contacts communicating with corresponding contacts in the ice tray and wherein the sensor provides electrical signals indicating the formation of ice through the releasable electrical contacts of the connector to the controller.

It is thus a feature of at least one embodiment of the invention to provide a thermal sensing ice tray that can be readily replaced by disconnecting then reconnecting a connector providing both mechanical and electrical connection. This allows improved repairability of the ice-maker or the ability to use a variety of different ice trays providing different sizes or ice cube geometries.

The ice tray may include a water receiving chute extending upward therefrom and providing a sloping surface diverting downwardly flowing water across the upper face of the ice tray.

It is thus a feature of at least one embodiment of the invention to reduce splashing of the water entering the ice tray at different pressures through the use of an integrated diverter chute.

The ice-maker may further include a slip ring system providing an electrical path from the releasable electrical contacts of the connector to the controller with rotation of the connector.

It is thus a feature of at least one embodiment of the invention to eliminate interconnecting wiring such as may flex and break during operation of the ice-maker and which can interfere with replacement of the ice tray if damaged during repetitive flexing.

The slip ring system may provide a set of rotating wipers attached to the connector and communicating with stationary conductive traces to provide the slip ring system.

It is thus a feature of at least one embodiment of the invention to provide a slip ring system that can integrate with a position sensor using similar mechanism.

Other features and advantages of the invention will become apparent to those skilled in the art upon review of the following detailed description, claims and drawings in which like numerals are used to designate like features.

Figure 1:
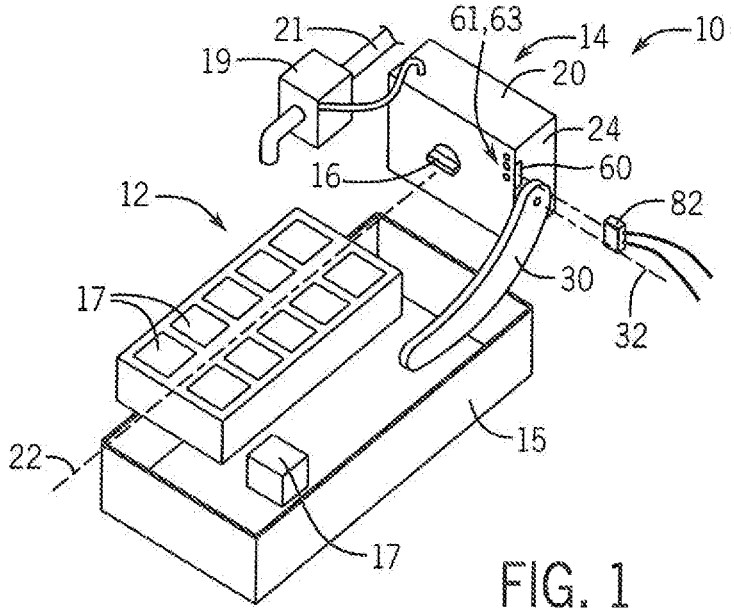
FIG. 1 is an exploded front devotional view of an ice-maker motor assembly such as may rotate an ice tray for filling and harvesting of ice into an ice bin and showing a bail arm integrated to the ice-maker motor assembly for detecting ice height.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an ice-maker 10 may include an ice tray 12 for receiving water and molding it into frozen ice cubes 17 of arbitrary shape. The ice tray 12 may be positioned adjacent to ice harvest drive mechanism 14 operating to remove cubes from the mold when they are frozen, for example, by inversion and distortion of the ice tray 12. The ice tray 12 may be positioned above an ice storage bin 15 for receiving cubes 17 therein when the latter are ejected from the ice tray 12.

The ice harvest drive mechanism 14 may have a drive coupling 16 exposed at a front wall 18 of a housing 20 of the ice harvest drive mechanism 14 and communicating with the mold 12 or comb. The drive coupling 16 may rotate about an axis 22 along which the ice tray 12 or comb extends.

The right wall 24 of the housing 20, flanking the front wall 18, may support one end of a bail arm 30 extending generally parallel to axis 22 allowing the bail arm 30 to pivot about a horizontal axis 32 generally perpendicular to axis 22 and extending from the right wall 24. As so attached, the opposed cantilevered end of the bail arm 30 may swing down into the ice storage bin 15 to contact an upper surface of the pile of cubes 17 in the ice storage bin 15 to determine the height of those cubes 17 and to deactivate the ice-maker 10 when a sufficient volume of cubes 17 is in the ice storage bin 15 to prevent full descent of the bail arm 30. The bail arm 30 may be a thermoplastic material attached to a rotatable shaft 36 extending along axis 32 through the housing 20.

A water valve 19 may receive tap water from a supply line 21 to provide water into the ice tray 12 under the control signals generated by the ice harvest drive mechanism 14 as will be discussed below.

Figure 2:
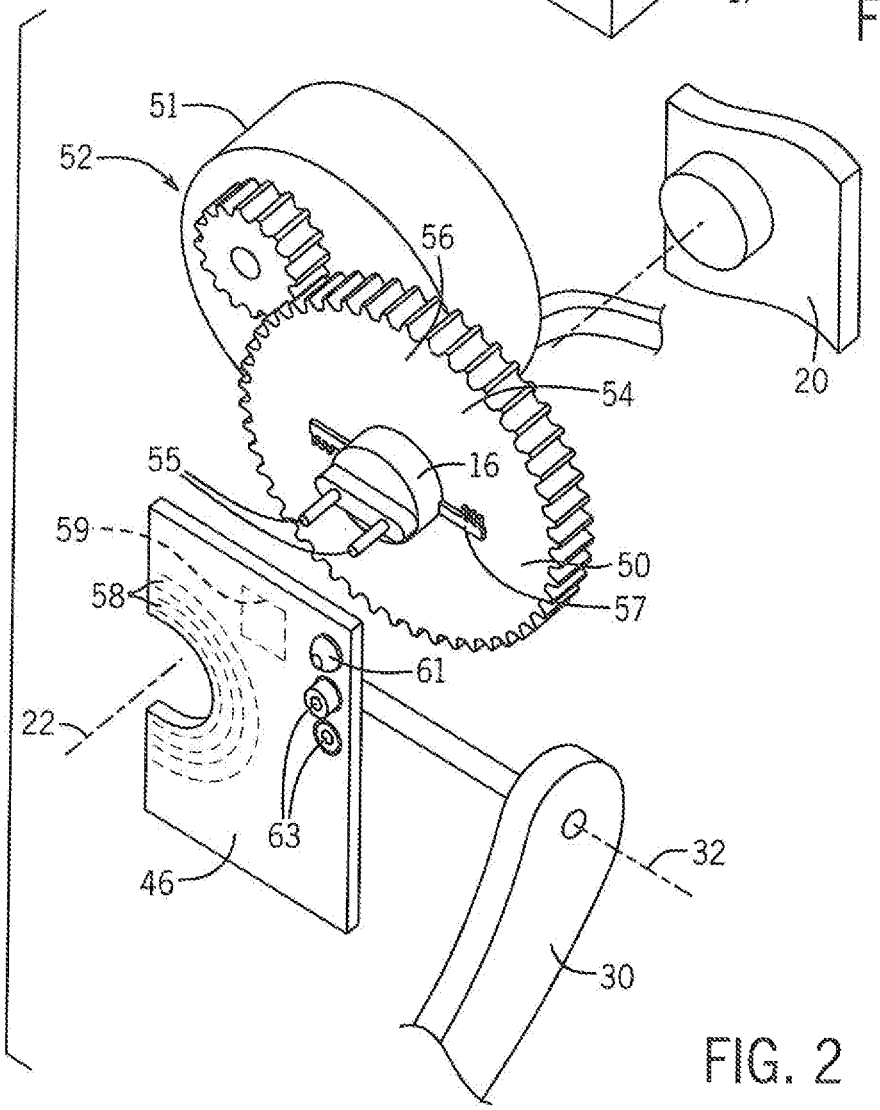
FIG. 2 is a front perspective view of a drive gear driven by a single phase AC synchronous motor, the drive gear communicating by a shaft to the ice mold, which supports an encoder wiper assembly on a front face of the drive gear that interacts with arcuate traces on a printed circuit board to provide an encoder-like indication of motor position and showing bail arm contact pads on that printed circuit board that may interact with a bail arm wiper on the bail arm for detecting bail arm position.

Referring now to FIGS. 1 and 2, the drive coupling 16 may be a center hub of a drive gear 50 being part of a gear train 52 ultimately driven by a single-phase, synchronous AC gear motor 51. The gear train 52 provides an increase in torque and a reduction in rotation speed of the motor to turn the drive gear 50 at about two revolutions per minute. The drive coupling 16 may support axially-extending left and right spring-loaded conductive pins 55 and corresponding left and right radially-extending conductive wipers 57 attached to respective ones of the left and right conductive pins 55. A front face 54 of the drive gear 50 opposes a printed circuit board 46 supporting arcuate traces 58 that may contact on the conductive wipers 57 with rotation of the gear 50 and drive coupling 16 about axis 22. The interaction of the conductive wipers 57 and arcuate traces 58 provides an encoder that indicates a rotational position of the gear 50, for example, as described in U.S. patent application Ser. No. 2015/027629 filed Oct. 22, 2013, and hereby incorporated by reference and discussed in greater detail below. In addition the conductive wipers 57 and arcuate traces 58 provide a slip coupling communicating electrical signals from the left and right spring-loaded conductive pins 55 to the printed circuit board 46 and ultimately to a microcontroller 59.

The microcontroller 59 including a processor, computer memory holding a stored program, and input/output circuits that may communicate with other components on the printed circuit board 46, including the traces 58, provides inputs related to the rotational position of the gear 50. The microcontroller 59 may also communicate with a three-color (RGB) LED 61 as will be discussed below and a first and second switch 63. Output signals from the microcontroller 59 may control the AC motor 51 and the electric valve 19 (shown in FIG. 1) connecting and disconnecting these components from the AC line voltage using a thyristor or the like communicating with the microcontroller 59 on the printed circuit board 46. The operation of the ice-maker 10 may therefore be controlled through the program stored in the computer memory of the microcontroller 59 as will be discussed below.

Figure 3:
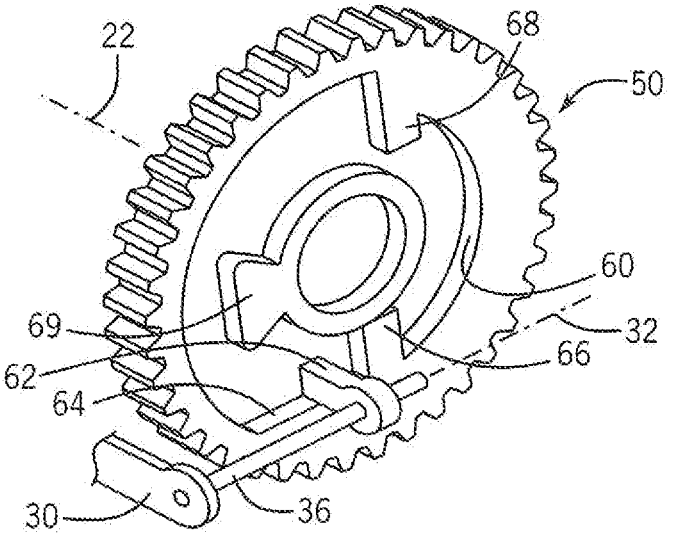
FIG. 3 is a rear perspective view of the drive gear of FIG. 2 showing its interaction with a reversing arm moving in rotation with the bail arm and the bail arm wiper.
Figure 4:
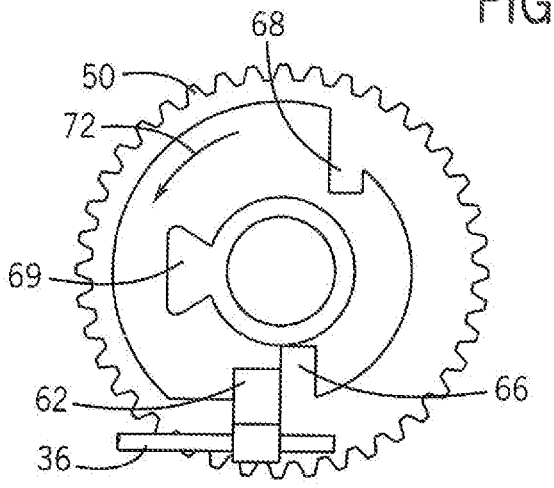
FIGS. 4-7 are rear elevational views of the drive gear and reversing arm at various rotations of the drive gear showing the interaction between the drive gear and the reversing arm for control of the operation of the attached AC motor.

Referring now to FIG. 3, the rear face of the gear 50 may provide for a rim 60 extending rearward and parallel to axis 22 around the periphery of the gear 50. A reversing arm 62 extending radially from the shaft 36 of the bail arm 30 perpendicular to axis 32 may rest on the rim 60 as the gear 50 turns, pulled against the rim 60 by the weight of the bail arm 30. The rim 60 may provide for a cam surface 64 that may raise and lower the bail arm 30 with rotation of the gear 50, the cam surface 64 extending progressively inward from the outer circumference of the gear 50 with clockwise rotation of the gear 50 with respect to the reversing arm 62.

Extending radially inward from the rim 60 is a first home-stop 66 presenting a radial face that may abut the reversing arm 62 preventing further rotation of the gear 50 in a clockwise direction past the home-stop 66 as depicted. Approximately halfway around the rim 60 is an end-stop 68 also providing a radial face that may abut the reversing arm 62 preventing further counterclockwise rotation of the gear 50 past the end-stop 68. When the home-stop 66 abuts the reversing arm 62, the ice tray 12 (shown in FIG. 1) is in its upright position ready to receive water. Conversely when the end-stop 68 abuts the reversing arm 62, the ice tray 12 is inverted and fully distorted for the ejection of ice cubes 17.

Partway between the home-stop 66 and end-stop 68 and extending radially outward from the center of the rear face of the clear 50 is a bin-full stop 69 having a limited radial extent presenting a gap between the outermost radial edge of the full-bin stop 69 and the inner surface of the rim 60.

Referring now to FIGS. 1, 2, 3, 4, and 8, during most of the operating time of the ice-maker 10, the gear 50 will be in the home position **72*a* with home-stop 66 abutting a right side (as depicted) of the reversing arm 62 with the AC motor 51 turned off by the microcontroller 59. At a predetermined interval determined by a timer in the microcontroller 59 and its executed program and sufficient time for water in the ice tray 12 to have frozen or a signal from a thermistor to be described (approximately −70 degrees centigrade), the AC motor 51 may be activated. As is understood in the art, a single-phase AC motor will operate in either direction with a preferred direction normally controlled by a ratchet. In this case, there is no ratchet and the abutment of reversing arm 62 and home-stop 66 serve to encourage starting of the AC motor 51 to rotate the gear 50 in a counterclockwise direction as indicated by arrow 72**.

Figure 5:
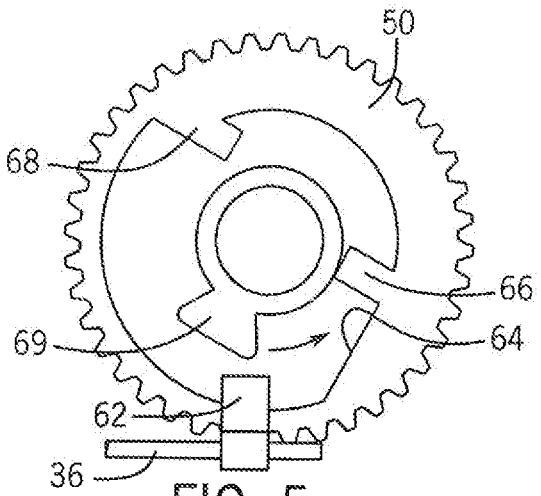
Figure 6:
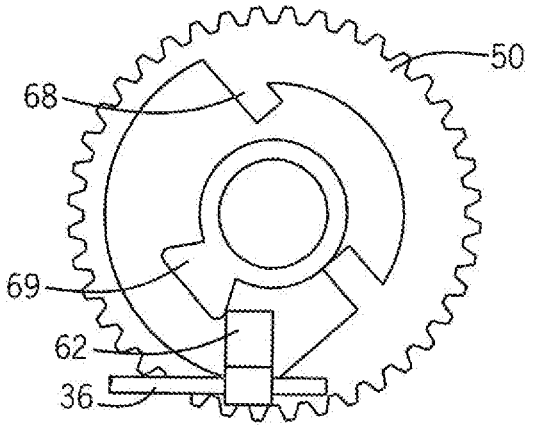
Figure 7:
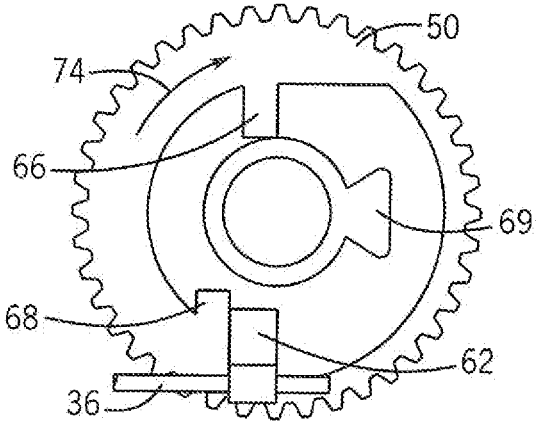
Figure 8:
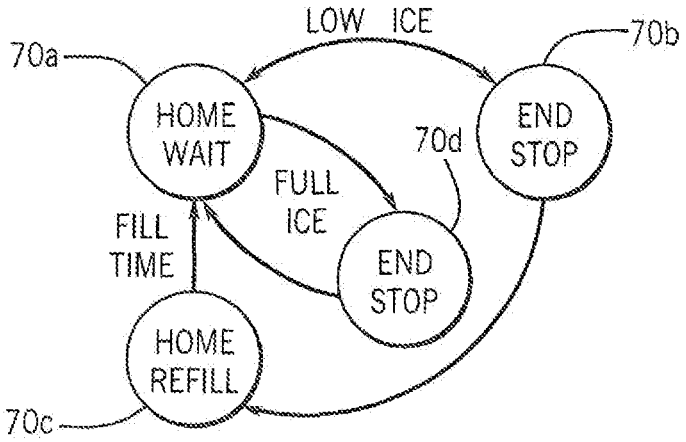
FIG. 8 is a state diagram of the cycling of the ice-maker and AC motor of the present invention.

Referring now to FIG. 5, with counterclockwise rotation, the reversing arm 62 will move along, then past, the cam surface 64 allowing the bail arm 30 to descend into the ice bin 15. If the ice bin 15 is sufficiently empty to allow full descent of the bail arm 30 (as shown in FIG. 5) then the reversing arm 62 can pass beneath the full-bin stop 69 permitting continued rotation of the gear 50 by about 82 degrees until the reversing arm 62 abuts the end-stop 68 as shown in FIG. 7 and as indicated by state **70*b* of FIG. 8. At this point, the ice tray 12 is twisted so as to discharge ice cubes 17 into the bin 15. After sufficient delay for full ejection of the ice cubes 17 during which the microcontroller 59 may turn off the AC motor 51, the AC motor 51 is again activated causing the gear 50 to begin to move in a clockwise direction 74 ultimately limited by the abutment of the reversing arm 62 and the end-stop 68**.

The ice tray 12 again returns to its upright position at the home refill state **70*c* at which time the motor 51 is deactivated by the microcontroller 59. The microcontroller 59 then may activate the valve 19 for a programmable fill time that will be discussed further below. After conclusion of the fill time and once the thermistor resistance indicates approximately zero degrees centigrade (indicating the presence of water), the ice-maker 10 reverts to the home state 70*a* without further rotation of the gear 50**.

Referring now to FIGS. 1, 2, 3, 6, and 8, in the event that the hail arm 30 cannot fully descend into the ice bin 15 as blocked by ice cubes 17, then the reversing arm 62 will not drop sufficiently to avoid contacting the bin-full stop 69. This contact between the reversing arm 62 and the bin-full stop 69 is indicated by state **70*d* in FIG. 8. This interference causes reversal of the AC motor 51 returning the gear 50 to the home position shown in FIG. 4. Failure to reach the end position of end-stop 68, however, is recognized by the microcontroller 59 through the encoder described above which causes the microcontroller 59 to eliminate the home refill state 70***c*. Nevertheless, by returning to the position of the home state 70*a*, the bail arm 30 is lifted out of the ice storage bin 15 to prevent obstruction when the ice storage bin 15 is withdrawn by the user.

Figure 9:
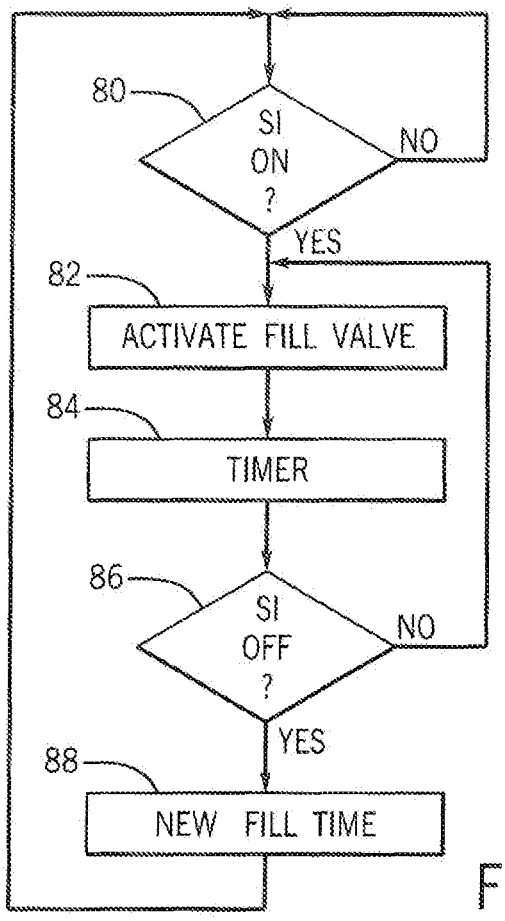
FIG. 9 is a flowchart executed by the control electronics on the printed circuit board of FIG. 2.

Referring now to FIGS. 1, 2 and 9, the LED 61 and switches 63 may be accessible outside of the housing 20 (optionally through a releasable cover) so that a first of the switches 63 (designated S1) may be activated by a user as detected by the microcontroller 59 per decision block 80. This detection may cause the program to indicate a calibration mode using the LED 61 and to activate the fill valve 19 outside of the normal operation of the ice-maker 10 as indicated by process block 82 and also to start operation of a timer as indicated by process block 84. The user may watch the fill level of the ice tray 12 and when a sufficient height has been obtained to completely fill the ice tray 12 to a desired level, release the pushbutton S1 as detected by process block 86. This release causes a new fill time to be recorded per process block 88 such as will be henceforth used in the home refill state 70*c* as discussed above. This ability of the user to set the fill time allows more consistent ice tray filling under conditions of low pressure (for example, in houses with well water) where constant flow valves may be ineffective.

The LED 61 and the other switch 63 may be used, for example, to run other diagnostic tests, for example, initiating a fill cycle or a harvesting of ice. In addition the LEDs 61 may flash or change color to indicate various failure modes in an extremely compact user interface suitable for the difficult environments of the interior of a refrigerator.

Example constructions of the gear train 52 and of other elements and components of the ice harvest drive mechanism 14 are described in U.S. patent application Ser. No. 2012/0186288 hereby incorporated in its entirety by reference.

Figure 10:
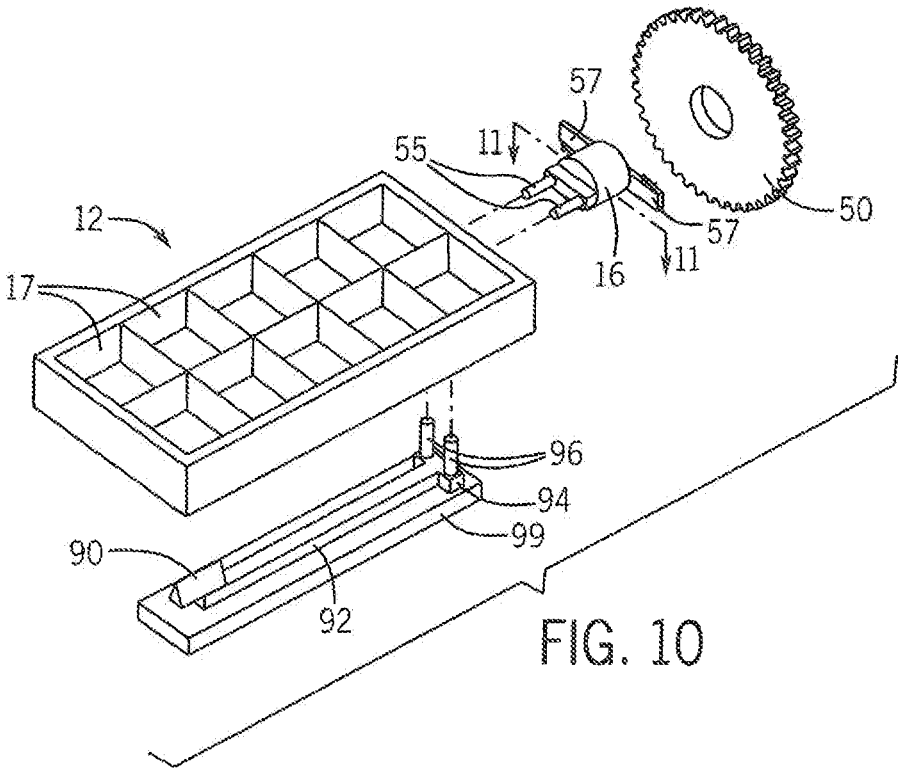
FIG. 10 is a simplified exploded view of the ice tray of FIG. 1 and its connection to the ice-maker motor assembly through an electrical/mechanical connector also connecting to a thermistor in the ice tray.
Figure 11:
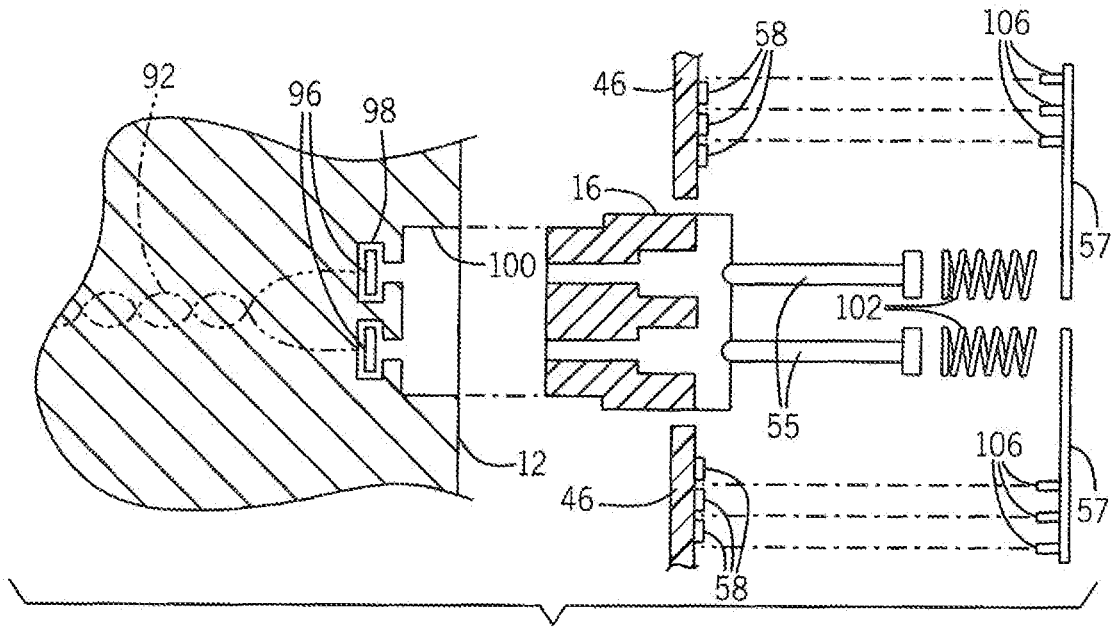
FIG. 11 is a fragmentary cross-section along line 11-11 of FIG. 10 showing a slip ring system providing traces and corresponding wiper aims to eliminate wire flexing and a spring-loaded electrical connector system communicating with the thermistor as incorporated into the electrical/mechanical connector.

Referring now to FIGS. 10 and 11, the ice fray 12 may incorporate a temperature sensor 90, for example, a thermistor or other temperature sensing element positioned beneath the ice tray 12 in close proximity to the volume holding a cube 17 so as to sense a temperature of that volume. Temperatures above the freezing point generally indicate incomplete freezing of the cubes whereas temperatures below freezing indicate that the cube has frozen and no additional phase change is occurring.

The temperature sensor 90 may communicate by conductors 92 to a connector 94 having upwardly extending blades 96 that may be received within corresponding slots 98 in an end of the ice tray 12. The temperature sensor, conductors, and connector 94 may be held in position by a cover plate 99 stepping into the bottom of the ice tray 12.

The slots 98 in the ice tray 12 receiving the blades 96 may communicate with a socket 100, the latter mechanically and releasably interengaging with the drive coupling 16 to support the ice tray 12 for rotation by the coupling 16. When the drive coupling 16 is in the socket 100, the connector pins 55 electrically connect to the blades 96 thereby also providing an electrical as well as a mechanical connection between the drive coupling 16 and the ice tray 12.

Referring still to FIG. 11, as noted above the connector pins 55 may be spring-loaded by means of helical compression springs 102 into engagement with the blades 96. The helical compression springs 102 may be electrically conductive to provide electrical communication between corresponding ones of the pins 55 and the conductive wipers 57 extending radially out from the drive coupling 16 having fingers 106 slidably communicating with the traces 58 on the printed circuit board 46.

Figure 12:
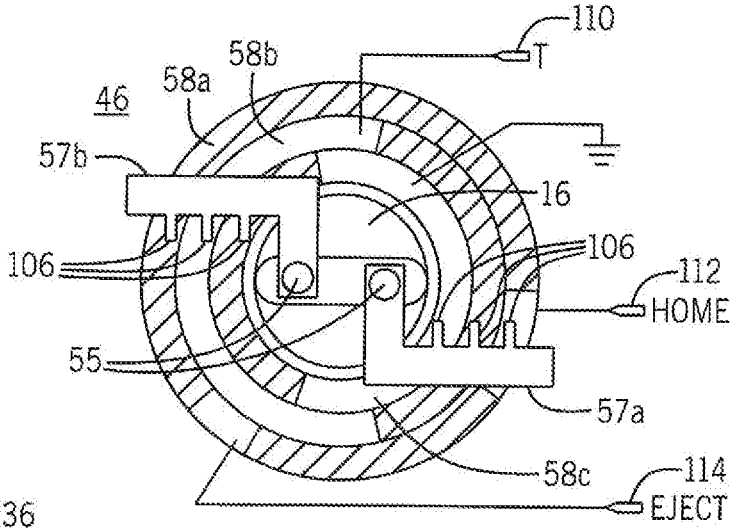
FIG. 12 is an elevational view of the slip ring system superimposing the wiper arms and traces with the ice tray shown in the home position.

Referring now to FIG. 12, in one embodiment, conductive wiper 57 may include three electrically intercommunicating fingers 106 and may communicate between one of the pins 55 and one of three concentric circularly constrained traces 58*a*, 58*b*, and 58*c*. In one embodiment, the innermost trace 58*c* may be connected to ground and extend approximately halfway around its circular path so that the rightmost conductive wiper 57*a* (as depicted in FIG. 12) will be grounded when the tray is in its normal upright position for filling and freezing (a shown in FIG. 12). Conversely the left side conductive wiper 57*b* will connect only to trace 58*b* which in turn connects to a terminal 110 providing a temperature signal of the temperature sensor 90 (shown in FIG. 10). In this way the temperature sensor 90 may be read during the freezing of the ice cubes and yet there is no flexing wire connection between the temperature sensor 90 and the printed circuit board 46 and hence the microcontroller 59, such as could break or interfere with removal of the ice tray 12.

In the fill position as shown in FIG. 12, the outer trace 58*a* is grounded through the right conductive wiper 57*a* and a signal from this trace provides a home signal 112 indicating that the tray is in the home or filling position.

With clockwise rotation of the drive coupling 16 carrying with it the conductive wipers 57 as the ice tray is moved to its flexing and discharging position, conductive wiper 57*a* will move off of the conductive portion of trace 58*a* indicating a movement from the home position. At an arbitrary angular motion, the conductive wiper 57*a* will contact a second portion of the outer trace 58*a* providing an eject signal 114 indicating that the tray is in the eject position to the microcontroller.

Figure 13:
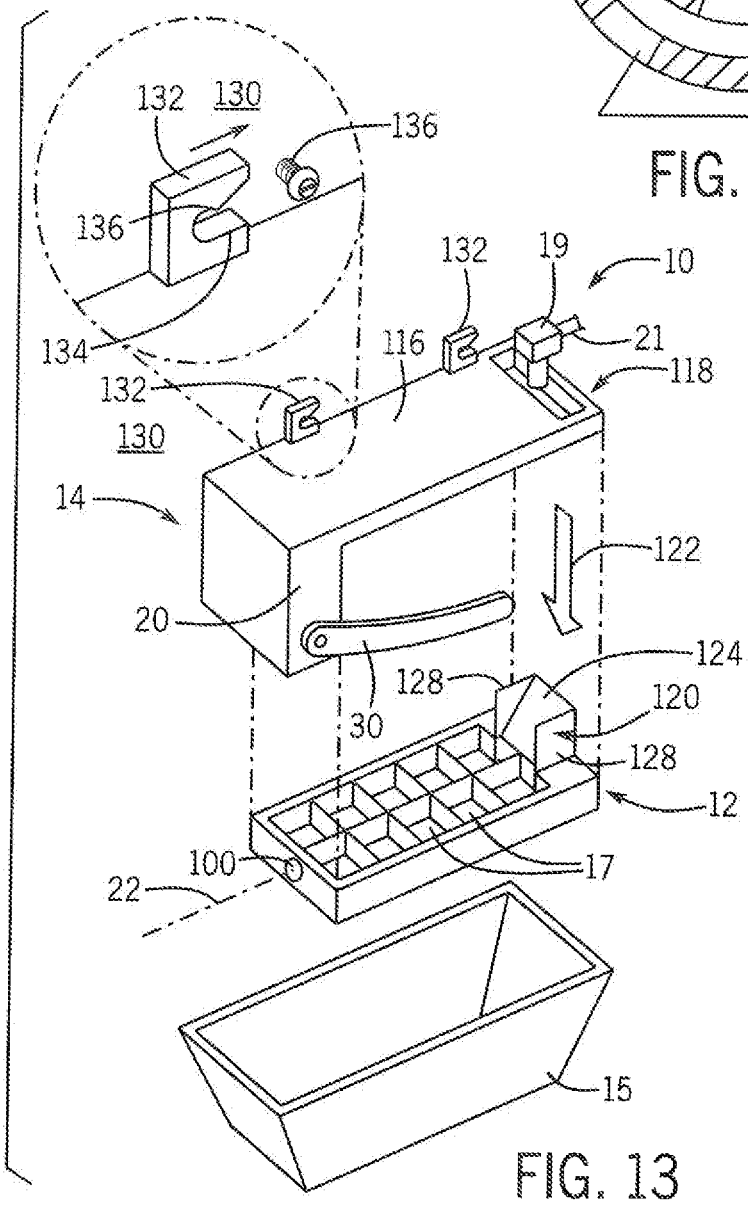
FIG. 13 is a figure similar to FIG. 1 in exploded form showing a hanger system and ice-tray water chute.

Referring now to FIG. 13, in one embodiment the ice harvest mechanism 14 may include an upper horizontal panel 116 extending over the ice tray 12 when the ice tray 12 is attached to the ice harvest mechanism 14. Extending downward from one end of the upper panel 116 is the housing 20 holding the motor drive unit shown in FIG. 2. The opposite end of the upper panel 116 provides an opening 118 through which water may be discharged downwardly from water valve 19 into the ice tray below the upper panel. For this purpose, the ice tray 12 may have an upwardly extending chute 120 at one end of the ice tray 12 receiving the downwardly discharged water as indicated by arrow 122. This falling water is received into the chute 120 which guides the water into the compartments in which the cubes 17 will be formed. This chute 120 is attached integrally to the ice tray 12 to rotate therewith and provides a sloping guide surface 124 gradually diverting the water from its downward, direction to a direction along axis 22 over the compartments holding the cubes 17. Sidewalls 128 flank this diverted water to help contain it in the correct direction. By integrating the chute 120 in with the ice tray 12, reduced splashing and water loss close to the tray 12 may be avoided and the greater height of the chute 112 permits a more gradual diversion of the water also preventing splashing.

An upper surface of the upper panel 116 proximate to a wall 130 of the refrigerator may support upwardly extending tabs 132 for mounting the icemaker 10 against the wall 130. The tabs 132 may have rearwardly extending slots 134 to engage screws or shoulder screw's 136 projecting horizontally from the vertical face of the wall 130 as the icemaker 10 is moved rearward providing a simple installation of the icemaker 10 in a refrigerator from the front of the refrigerator. The slots 134 may have a constriction 136 allowing them to snap over the shaft of the screws 136 to prevent inadvertent dislodgment of the icemaker 10. The screws 136 may then be tightened further over the tabs 132.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

The term "cube" should be understood to be an ice element not limited to any particular shape such as a cube. Generally, the invention contemplates at multiple different ice cube geometries may be used including cylinders, hemi cylinders, hemispheres and the like.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties

What is claimed is:

1. An ice-maker comprising:

an ice tray providing multiple cube forming compartments open on an upper face of the ice tray for receiving water to mold ice;

a drive mechanism, including:

a motor unit providing an AC motor operable to rotate the ice tray alternately in either of two directions between a first position to allow filling the compartments with water and a second position to provide warpage of the tray with the warpage of the tray discharging the ice cubes from the compartment;

a first stop arranged in the drive mechanism that blocks further rotation of the ice tray when the ice tray rotates in a first direction and causes reversal of the AC motor to rotate the ice tray in a second direction that is opposite the first direction;

a second stop arranged in the drive mechanism that blocks further rotation of the ice tray when the ice tray rotates in the second direction and causes reversal of the AC motor to rotate the ice tray in the first direction; and a position sensor sensing at least one rotated location of the tray; and a controller responding to the position sensor to control power to the AC motor to provide a cycling of the tray between the first and second positions for ice making.

2. The ice-maker of claim 1 further including an ice bin positioned beneath the ice tray to receive ice cubes discharged from the ice tray in the second position and a bail arm operable by the AC motor to descend into the ice bin as the tray moves from the first position to the second position.

3. The ice-maker of claim 2 further including a third stop blocking the rotation of the AC motor when the tray is between the first and second, position before warpage of the tray and wherein the bail arm provides a movable finger interacting with the third stop only when the bail arm is blocked at a predetermined elevation from descent into the ice bin indicating a full state of the ice bin, interaction of the movable finger with the third stop reversing the AC motor before the tray reaches the second position.

4. The ice-maker of claim 3 wherein the movable finger further interacts the first and second stops to block rotation of the AC motor at the first and second stop.

5. The ice-maker of claim 1 wherein the AC motor is an AC synchronous motor.

6. The ice-maker of claim 1 wherein the controller operates to provide power to the AC motor when the tray is between the first and second positions and to selectively stop the AC motor at the first and second positions.

7. The ice-maker of claim 1 wherein the drive mechanism includes a drive coupling that is axially connected to a gear having the first and second stops on a surface of the gear and wherein the AC motor shaft communicates with the gear through at least one additional gear.

8. The ice-maker of claim 7 wherein the position sensor is a set of electrical contacts interconnecting with conductive wipers on the gear.

9. The ice-maker of claim 1 wherein the ice-maker provides an electrically actuatable valve communicating with the controller to be activated by the controller for delivering water to the ice tray in the first position.

10. The ice-maker of claim 9 wherein the controller includes at least one switch actuatable by a user of the ice-maker to open the valve at a first time and close the valve at a second time indicating an amount of time necessary to fill the ice tray; and wherein the controller stores an indication of the amount of time to use to control the electrically actuatable valve at subsequent times when the tray is in the first position for filling with water.

11. The ice-maker of claim 1 wherein the ice tray includes a sensor communicating with at least one cube-forming compartment to sense formation of ice.

12. The ice-maker of claim 11 wherein the connector releasably attaches to the ice tray and includes releasable electrical contacts communicating with corresponding contacts in the ice tray and wherein the sensor provides electrical signals indicating the formation of ice through the releasable electrical contacts of the connector to the controller.

13. The ice-maker of claim 12 wherein the controller employs the electrical signals from the sensor to initiate power to the AC motor when the tray is in the first position and ice has formed to move the tray to the second position.

14. The ice-maker of claim 11 wherein the ice tray includes a water receiving chute extending upward therefrom and providing a sloping surface diverting downwardly flowing water across the upper face of the ice tray.

15. The ice-maker of claim 11 further including a slip ring system providing an electrical path from the releasable electrical contacts of the connector to the controller with rotation of the connector.

16. The ice-maker of claim 15 wherein the slip ring system provides a set of rotating wipers attached to the connector and communicating with stationary conductive traces to provide the slip ring system.

17. The ice-maker of claim 16 wherein the set of rotational wipers includes at least one wiper providing the position sensor.

18. A method of operating an ice-maker of a type having:

an ice tray providing multiple cube forming compartments open on an upper face of the ice tray for receiving water to mold ice; and a drive mechanism including:

(i) a motor unit providing a an AC motor operable to rotate the ice tray alternately in either of two directions between a first position to allow filling the compartments with water and a second position to provide warpage of the tray with the warpage of the tray discharging the ice cubes from the compartments;

(ii) a first and a second stop arranged in the drive mechanism and blocking rotation of the AC motor when the tray is in the first and second positions respectively to cause reversal of the direction of operation of the AC motor at those positions; and (iii) a position sensor sensing at least two rotated locations of the tray;

the method comprising the steps of:

(a) after a time period during which the tray is in the first position and ice has formed in the tray, activating the motor;

(b) allowing motion of the AC motor to be blocked by the first stop to reverse the motor;

(c) after step (a) deactivating the motor when the tray has returned to the first position.

19. The method of claim 18 wherein the ice-maker further includes an ice bin positioned beneath the ice tray to receive ice cubes discharged from the ice tray in the second position and a bail arm operable by the AC motor to descend into the ice bin as the tray moves from the first position to the second position and further including a third stop blocking the rotation of the AC motor when the tray is between the first and second position before warpage of the tray and wherein the bail arm provides a movable finger interacting with the third stop only when the bail arm is blocked at a predetermined elevation from descent into the ice bin indicating a full state of the ice bin, interaction of the movable finger with the third stop reversing the AC motor before it reaches the second position; the method further including the step of:

(d) when the bail arm is blocked at a predetermined elevation from descent into the ice bin, blocking the motion of the AC motor to reverse the motor.

* * * * *